US006780099B1

(12) United States Patent
Harper

(10) Patent No.: US 6,780,099 B1
(45) Date of Patent: Aug. 24, 2004

(54) ROOF VENTILATION SYSTEM

(76) Inventor: Richard W. Harper, 3950 Jay Rd., Whitehall, MI (US) 49461

( * ) Notice: Subject to any disclaimer, the term of this patent is extended or adjusted under 35 U.S.C. 154(b) by 0 days.

(21) Appl. No.: 10/424,413

(22) Filed: Apr. 28, 2003

(51) Int. Cl.[7] ..... E04D 13/17
(52) U.S. Cl. ..... 454/186; 52/95; 454/185
(58) Field of Search ..... 454/185, 186, 454/260, 365, 367, 368; 52/57, 95

(56) References Cited

U.S. PATENT DOCUMENTS

| | | | | | |
|---|---|---|---|---|---|
| 1,686,118 | A | * | 10/1928 | Barrie | 52/302.3 |
| 3,368,473 | A | * | 2/1968 | Sohda et al. | 454/185 |
| 3,797,180 | A | * | 3/1974 | Grange | 52/95 |
| 4,007,672 | A | | 2/1977 | Luckey | 98/37 |
| 4,184,416 | A | | 1/1980 | Koontz | 98/37 |
| 4,254,598 | A | * | 3/1981 | Rugroden | 52/199 |
| 4,278,071 | A | | 7/1981 | Brill-Edwards | 126/428 |
| 4,635,419 | A | * | 1/1987 | Forrest | 52/302.3 |
| 4,642,958 | A | | 2/1987 | Pewitt | 52/302 |
| 4,817,506 | A | | 4/1989 | Cashman | |
| 4,876,950 | A | | 10/1989 | Rudeen | |
| 4,937,990 | A | | 7/1990 | Paquette | 52/199 |
| 4,942,699 | A | | 7/1990 | Spinelli | 52/57 |
| 4,977,714 | A | * | 12/1990 | Gregory, Jr. | 52/95 |
| 5,007,216 | A | | 4/1991 | Pearson | 52/94 |
| 5,022,314 | A | | 6/1991 | Waggoner | |
| 5,149,301 | A | | 9/1992 | Gates | 454/365 |
| 5,352,154 | A | | 10/1994 | Rotter et al. | 454/365 |
| 5,473,847 | A | | 12/1995 | Crookston | 52/302.1 |
| 5,603,657 | A | | 2/1997 | Sells | 454/359 |
| 5,676,597 | A | | 10/1997 | Bettoli et al. | 454/365 |
| 5,826,383 | A | | 10/1998 | Garrison | 52/198 |
| 5,941,028 | A | * | 8/1999 | Hicks | 52/95 |
| 5,947,817 | A | | 9/1999 | Morris et al. | 454/365 |
| 6,079,166 | A | | 6/2000 | Mason et al. | 52/198 |
| 6,203,424 | B1 | | 3/2001 | Gallant | 454/365 |
| 6,325,712 | B1 | | 12/2001 | Lawless, III et al. | 454/277 |
| 6,346,040 | B1 | | 2/2002 | Best | 454/260 |
| 6,347,991 | B1 | | 2/2002 | Bogrett et al. | 454/260 |
| 6,357,185 | B1 | | 3/2002 | Obermeyer et al. | 52/95 |
| 6,418,678 | B2 | | 7/2002 | Rotter | 52/199 |
| 6,458,029 | B2 | | 10/2002 | Morris | 454/365 |
| 2001/0019941 | A1 | | 9/2001 | Headrick | 454/365 |
| 2002/0187744 | A1 | | 12/2002 | Cedergreen et al. | 454/365 |

FOREIGN PATENT DOCUMENTS

| | | | | |
|---|---|---|---|---|
| JP | 4-190029 | * | 7/1992 | 454/186 |

* cited by examiner

*Primary Examiner*—Harold Joyce
(74) *Attorney, Agent, or Firm*—Gifford, Krass, Groh, Sprinkle, Anderson & Citkowski, P.C.

(57) ABSTRACT

A ventilation system for use with a peaked roof, the roof extending between lower-most extending edges disposed proximate to fascia boards and an upper-most extending peak. A plurality of interconnecting panels are assembled upon at least first and second angled sides of the roof, each of the panels exhibiting a length, width and thickness and defining a plurality of internal and lengthwise extending airflow passages. The panels are further interconnected along at least one of opposing side and end extending edges and so that the airflow passages align between the lower-most extending edges of the roof and the upper-most extending edges, associated with the peak. In this manner, airflow currents are drawn through the aligned airflow passages of the interconnected panels, in an upwardly angled manner, and exhausted along the extending peak.

13 Claims, 5 Drawing Sheets

ROOF VENTILATION SYSTEM

BACKGROUND OF THE INVENTION

1. Field of the Invention

The present invention relates generally to roof ventilation systems. More specifically, the present invention discloses a roof ventilation and air quality conditioning system by which a number of individual panels are interlockingly and communicably assembled upon a roof structure and such as dry upon a planking/insulation substrate and underneath an exterior layering of shingles. The system is constructed to create a continuous flow pattern of air through the panels and in order to offset both thermal gain (associated with sun ray permeation) and thermal loss (associated with interior heat loss in winter) conditions. The system further is utilized in combination with other components such as vent drip edges mounted-to the side fascia of the structure and power (fan, blower) vented assemblies for drawing air currents through the panels. The invention further discloses a hip/valley cap for use in interconnecting extending side edges of associated panels within the system assembly.

2. Description of the Prior Art

A known problem in the art is the excessive cost and potential harm associated with structural damage caused by excessive ice buildup, and such as which particularly occurs in colder climate locations. Ice buildup is typically caused by improper ventilation and, for instance, beam-plank roof structures have been found to provide no adequate degree of ventilation; this problem being most attendant in roof structures exhibiting a significant degree of pitch or peak, and such as in particular are found in churches. Additionally, build-up of flat roof structures have also been found to provide a very small degree of ventilation and an additional issue is presented in the weight of the ice build up upon the structure.

Additional problems associated with ice buildup upon a roof include the occurrence of ice melt dams behind the build up and which, upon backing up under the shingles associated with the roof, cause interior ceiling damage. Additional problems include the formation of large icicles on the roof as well as formations of ice which can damage windows, siding and landscape. Other problems associated with summertime conditions include the radiant heat upon roof structures penetrating through the roof and resulting in extensive cooling (air conditioning) expenses and as well as the undue wear associated with the roofing materials.

Attempts have been made in the prior art to address these problems and includes such as Pewitt, U.S. Pat. No. 4,642,958, which teaches a ventilated wall and roofing having, as best shown in FIG. 2, a wind powered air educator and which can be disposed between a roof exterior and interior. Airflow is provided through a plurality of opposing and corrugated metal sheets (having an open and axially extending/undulating pattern) and abutting at the roof gable line and inter-engaged by a baffle plate arrangement.

U.S. Pat. No. 4,635,419, issued to Forrest, teaches a vented roof construction with a series of vented air circulation passages arranged between the outer roofing layer and inner sealed insulation layers and in order to prevent accumulation of moisture within the insulated inner portion of the roof structure. Cashman, U.S. Pat. No. 4,817,506, teaches a roof vent exhibiting, in side profile, a rectangular vent structure and which is disposed along a roof ridge.

Of note, the V shaped assembly in Cashman is secured atop the exterior shingle surface of the structural peak and incorporate spaced apart partitions between which are defined lengthwise extending baffles. Other roof ventilation patents worthy of mention include U.S. Pat. No. 5,022,314, issued to Waggoner, U.S. Pat. No. 6,458,029, issued to Morris (ridge vent cap), U.S. Pat. No. 6,325,712, issued to Lawless, III and U.S. Pat. No. 5,473,847, issued to Crookson.

SUMMARY OF THE PRESENT INVENTION

The present invention discloses a roof ventilation and air quality conditioning system by which a number of individual panels are interlockingly and communicably assembled upon a roof structure, and such as dry upon a planking/insulation substrate and underneath an exterior layering of shingles. As previously also described, the system is constructed to create a continuous flow pattern of air through the panels, and further such as between a lower extending vent drip edge and a vented ridge cap, and in order to offset both thermal gain (associated with sun ray permeation) and thermal loss (associated with interior heat loss in winter) conditions.

The system further is utilized in combination with other components, such as again the vent drip edge strips mounted to associated side fascia of the structure, the peak ridge caps, and also including power (fan, blower) vented assemblies, such further being mounted in relation to the ridge and for drawing air currents through the interlockingly engaged panels. Additionally disclosed are hip/valley caps for use in interconnecting extending side edges of associated panels, in particular the outer-most associated and open-ended airflow passages associated with the panels, within the system assembly and such as along hip and valley locations of the roof.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
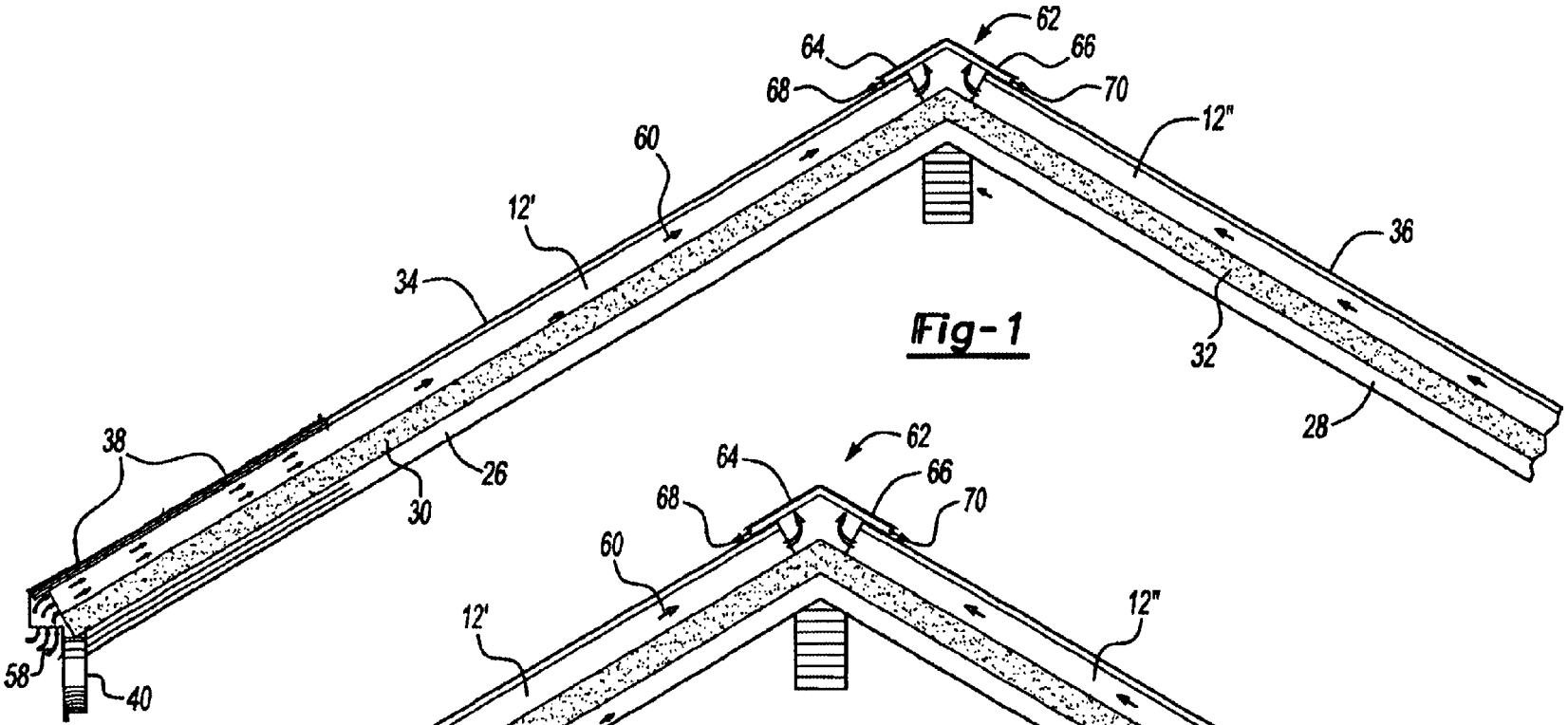
FIG. 1 is a side cutaway view of the roof ventilation system according to the present invention and illustrating first and second panel assemblies applied upon a roof structure in combination with a peak mounted and vented ridge cap and fascia mounted drip edge and further showing an exterior layering of shingles.

Referring now to FIGS. 1–5, a series of views are presented of a roof ventilation system according to a preferred embodiment of the present invention. As previously described, the system is constructed to create a continuous flow pattern of air through the panels and in order to offset both thermal gain (associated with sun ray permeation) and thermal loss (associated with interior heat loss in winter) conditions occurring along the roof, Referring in particular to FIG. 4, the overall assembly is illustrated generally at 10 and includes a plurality of individual panels 12, 14, 16, et seq. Each of the panels exhibits, in the preferred embodiment, an overall rectangular configuration including a length, width and thickness. An interior of each of the panels further establishes a plurality of lengthwise extending airflow passages, and as is best further illustrated, referring to selected panel 16, by triangular shaped baffle members 20 which create correspondingly triangular shaped apertures 22 extending the length of the panel.

As will be further described in detail, the individual panels 12, 14, 16, et seq., are arranged in either or both of sideways or end-to-end communication fashion and so that the airflow passages are arranged in aligning and communicating fashion. Additional features associated with each of the panels includes them being constructed of a plasticized (such as a polycarbonate with embossed textured surface) or other suitable material, as well as the panels including a plurality of apertures (see at 24 in FIG. 3 for panel 14) extending between top and bottom faces thereof and in order to reduce moisture accumulations.

Prior to engaging in further description of the ventilation system and associated components, a preliminary explanation will be given of the features of the conventional roof with which the present invention is applied. In particular, and referring first to FIGS. 1 and 2, a pair of peaked sides of the roof is represented by angularly disposed laminated planking or the like and which are referenced at 26 and 28. Additional components of the roof may include such as a layer of insulation, such as a 2" layer of a Styrofoam or like material, and which is shown at 30 and 32 supported upon planking layers 26 and 28, respectively.

In its usual application, the assembled and aligning panels 12, 14, 16, et seq., are supported upon the exterior facing surfaces of the insulating layer 30 and 32 and may be secured such as by mechanical fasteners, adhesives or the like. A plywood layer, see at 34 and 36, is applied upon the upper and exposed layer of the assembled panels, see for example panels 12' and 12" arranged-in peaked fashion in FIGS. 1 and 2. Finally, a plurality of rows of shingles 38 (see again FIG. 1) are applied upon the outer plywood layers 34 and 36 and so that the assembled panels are sandwiched in the interior of the roof and between the shingles and outer planking and the interior planking and insulation. In this fashion, the ventilation system is capable of operating in its optimum manner for conducting both heat loss and gain from the across substantially the entire roof location and through the peak ridge of the roof, as will be shortly explained.

Figure 3:
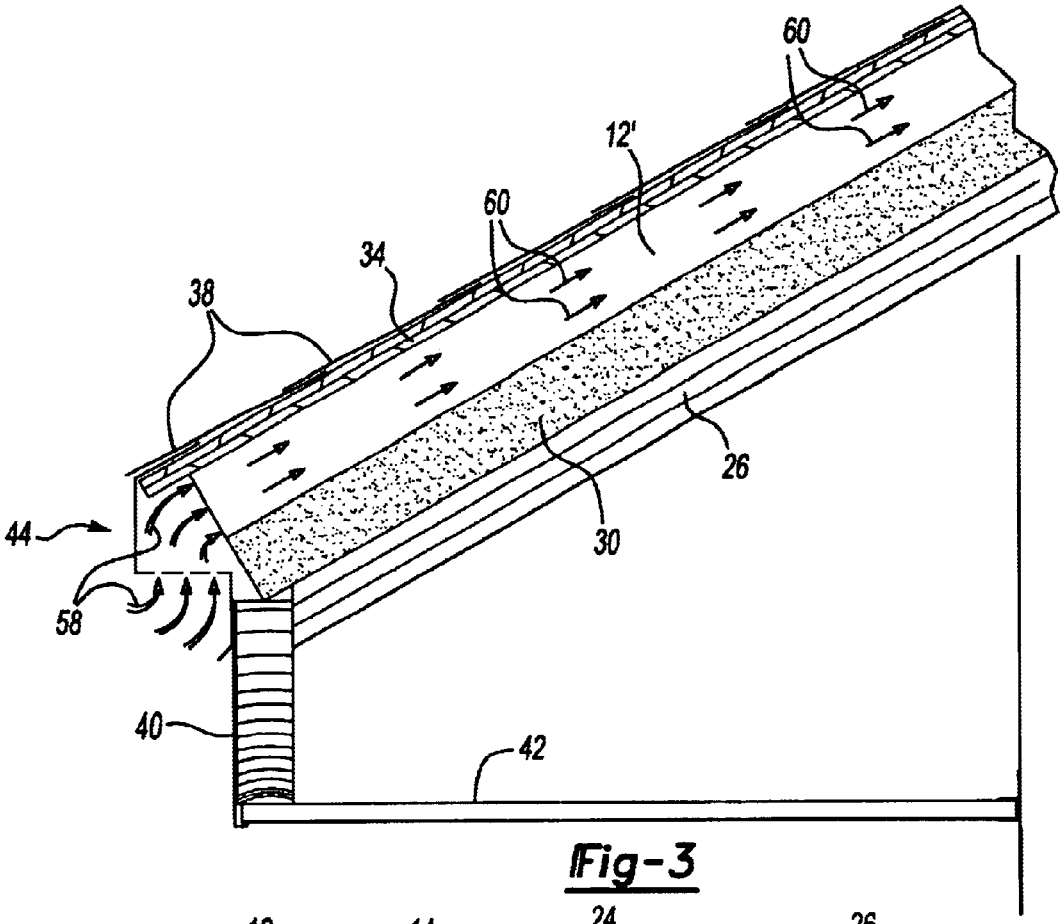
FIG. 3 is an enlarged illustration of the vented drip edge application of the roof ventilation system according to the present invention.
Figure 4:
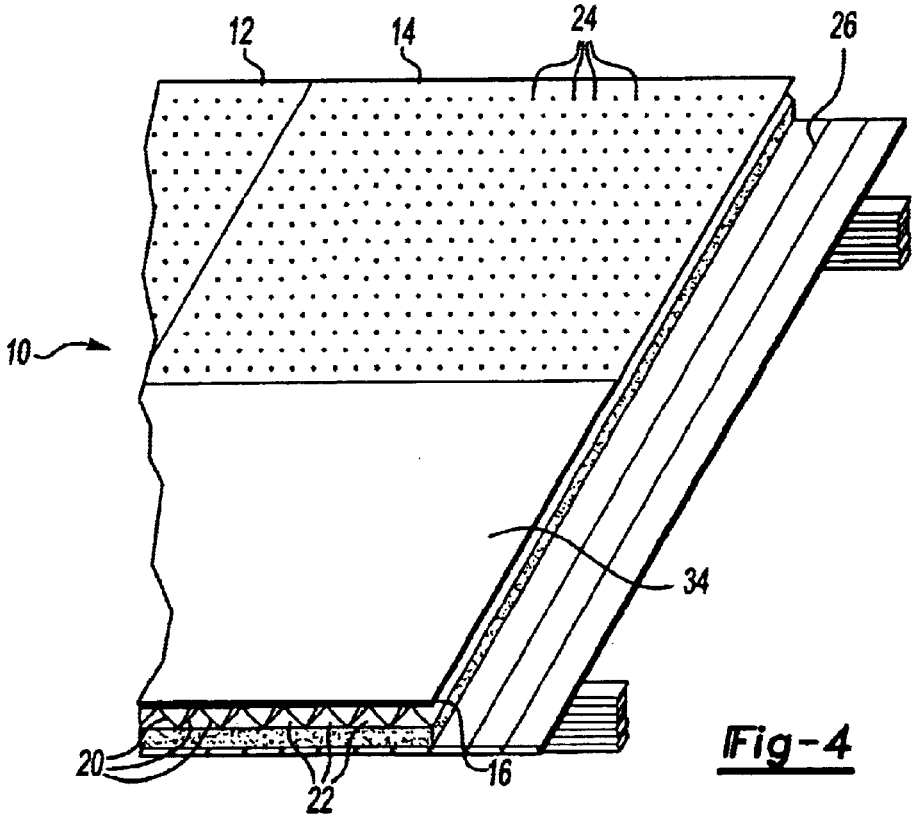
FIG. 4 is a cutaway perspective illustration of a plurality of interconnected vent panels and illustrating the features of the vent holes formed through the panels in order to reduce moisture accumulation.
Figure 5:
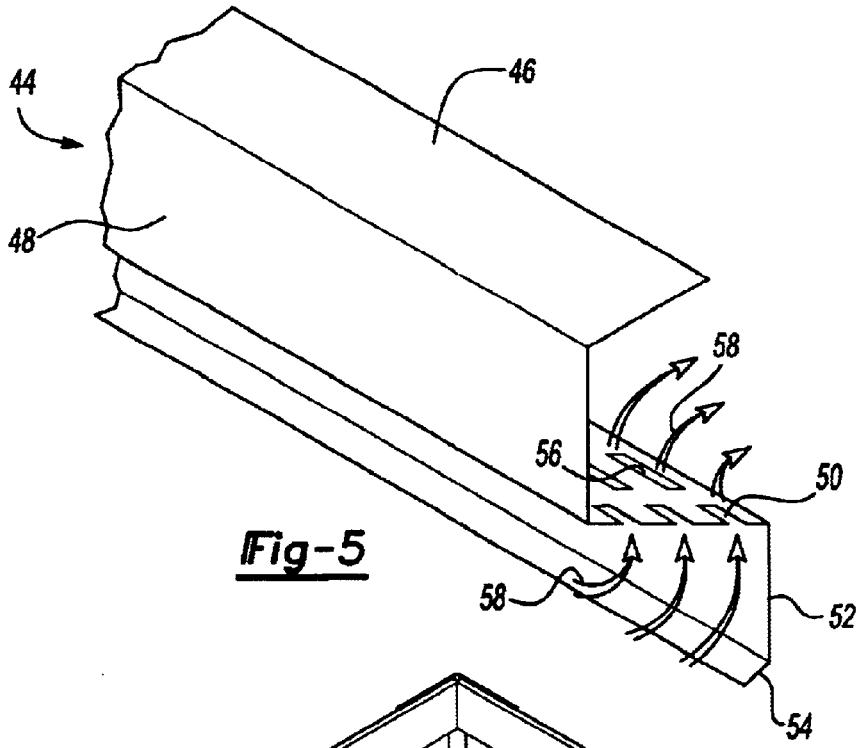
FIG. 5 is a sectional perspective of a selected vent drip edge strip incorporated into the roof ventilation system.

Referring further to FIG. 3, an extending fascia board 40 is illustrated and which is in proximity to a lower angled edge of the roof planking 26, insulating material 30, panel 12', and nailing layer 34. Also shown in FIG. 3 is an aluminum soffit panel 42 extending in substantially horizontal and inward fashion from a lower edge of the vertically disposed fascia board 40.

In a preferred embodiment, a vented drip edge strip is secured along each of the fascia boards and in order to be in communicating fashion with the lower-most extending edges of the panel assemblies and in particular with the associated open ends of airflow passages defined in the panels. In particular, a selected vented drip edge strip is illustrated in phantom in FIG. 4 and, as further best shown in solid in FIG. 5, includes an angular configuration in cross section, see interconnected sides 46, 48, 50, 52 and 54 and so that the drip edge strip is capable of being mounted in the fashion illustrated in FIG. 4.

The selected side 50 of the strip 44 further extends in a substantially horizontal fashion and further exhibits a plurality of apertures 56 defined therethrough which communicate the exterior environment with the airflow passages (see again at 22 in FIG. 4) at the lower-most extending edges of the panel assembly. Referencing again FIGS. 3 and 5, airflow patterns, see arrows 58, are drawn into and through the drip edge strips 44 and, after communicating with the interior airflow passages of the panels, are drawn inwardly and upwardly by the directional arrows further shown at 60 in FIGS. 1–3.

Figure 2:
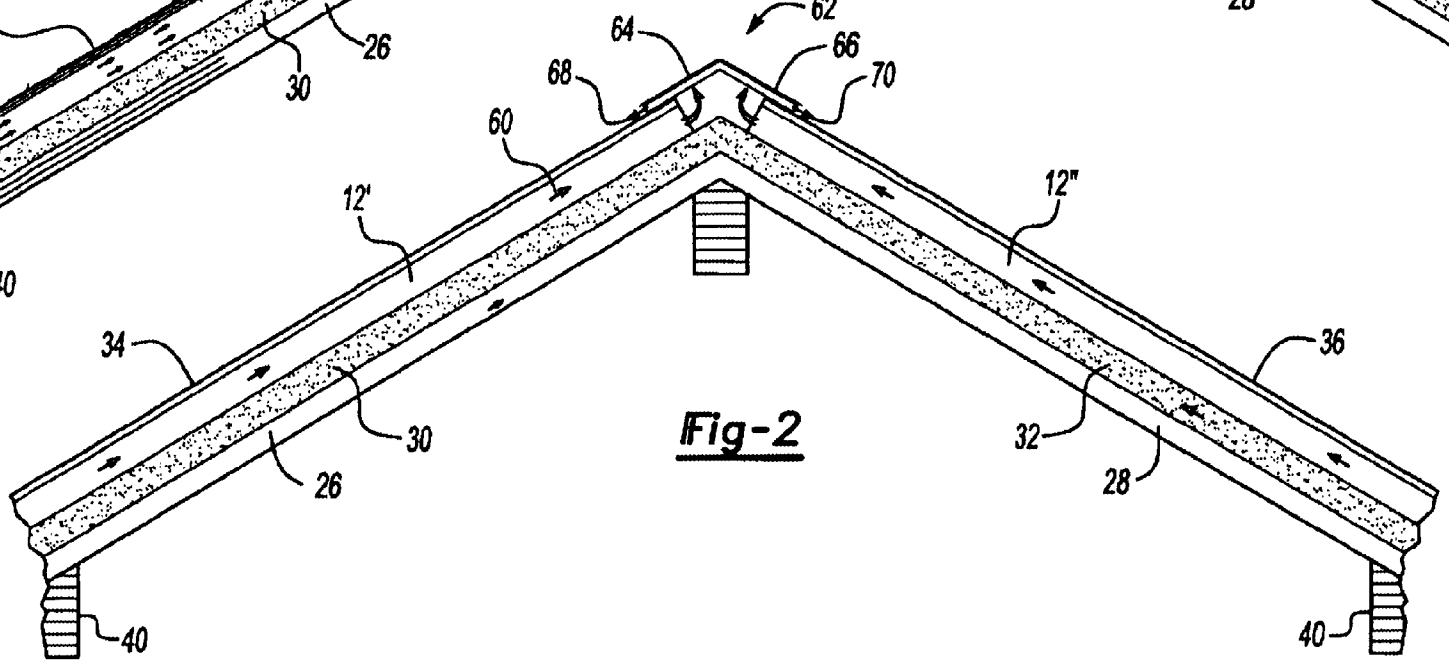
FIG. 2 is a simplified side cutaway of the ridge arrangement illustrated in FIG. 1.

As best shown again in FIGS. 1 and 2, a vented ridge cap is illustrated generally at 62 and is secured upon the peaked roof, in communication with the upper-most extending and opposingly angled and spaced edges of the interconnected panels. As is further illustrated, the vented ridge cap 60 exhibits a substantially "V" shape in cross section, with angles sides 64 and 66, and is secured along the roof peak at a spaced and predetermined distance above the associated surface edges of the panels again referenced at 12' and 12".

As is best illustrated in FIGS. 1 and 2, one preferred application of the ventilation system is in drawing the airflow currents, see again as represented by arrows 58 and 60, across the spacing established between the angled sides 64 and 66 and the corresponding top and open ended surfaces of the panels 12' and 12"; this being further represented by arrows 68 and 70 in FIGS. 1 and 2 and in order to vent the thermal gain or loss component to the exterior environment. It is also understood that at least one layer of shingles may be secured atop the first and second sides 64 and 66 associated with the vented ridge cap 62 and in order to provide a more consistent appearance to the completed assembly.

Figure 6:
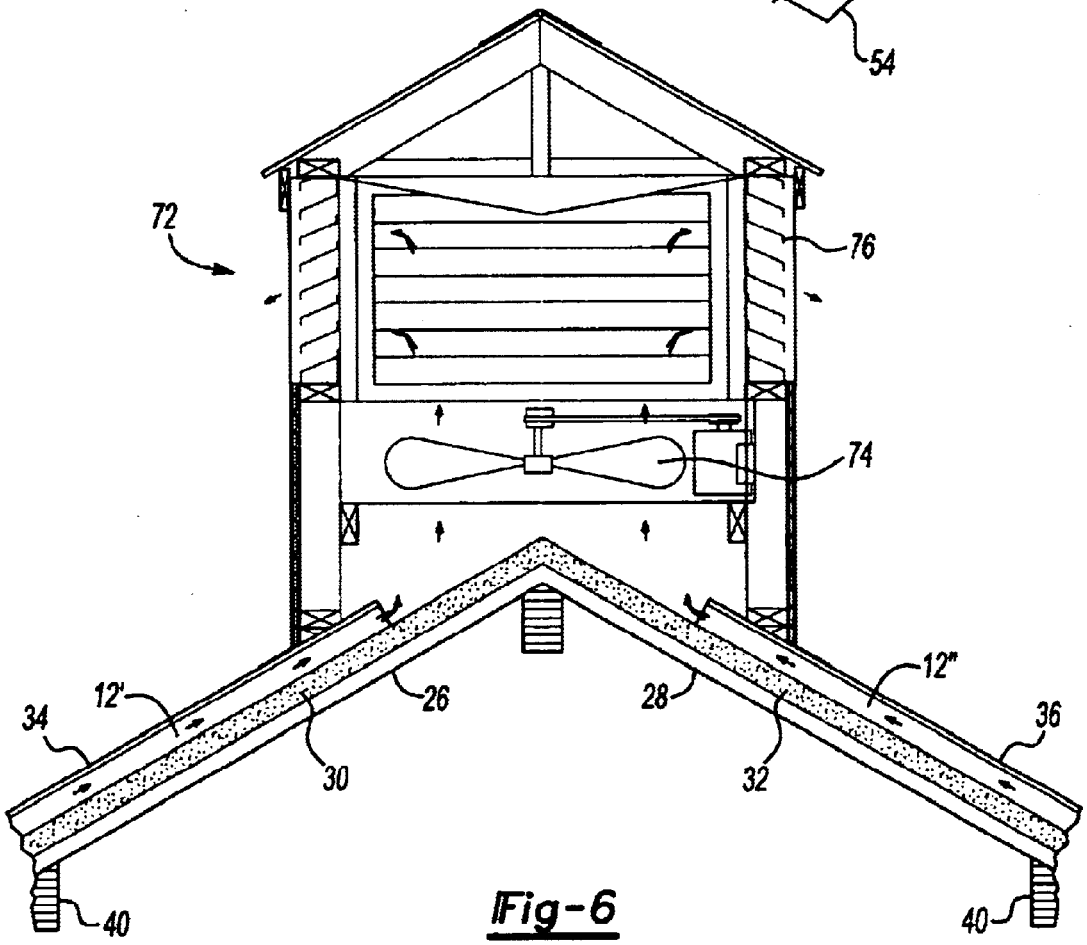
FIG. 6 is a side cutaway illustration of a power venting assembly incorporated into the roof ventilation system and showing the manner in which the air currents are drawn through the assembled panels, to the peak ridge, and vented.

Referring to FIG. 6, a fan driven apparatus is generally referenced at 72 secured atop the peaked roof and in communication with the upper-most extending edges of the interconnected panels, again referenced by example at 12' and 12". Of most relevance to the apparatus 72, a fan 74 (or other suitably driven unit such as a blower) is provided for drawing the airflow currents through the lower drip edge strip 44 and upwardly through the assembled and intercommunicating panels, after which they are vented outwardly through a vented cupola 76 or like apertured portion formed through the sides or top of the apparatus 72 and in order to create the desired airflow pattern.

It is also again understood that the fan driven apparatus 72 may be used either in combination with one more sideways extending ridge caps, which may or may not be sealed atop the peaked ridge in this variant. It is further understood that the present invention contemplates both powered air evacuation as well as ambient (non-driven) applications for creating airflow through the assembled and interconnected panels and in order to achieve the desired dissipation of thermal gain/loss across the roof surface.

Figure 7:
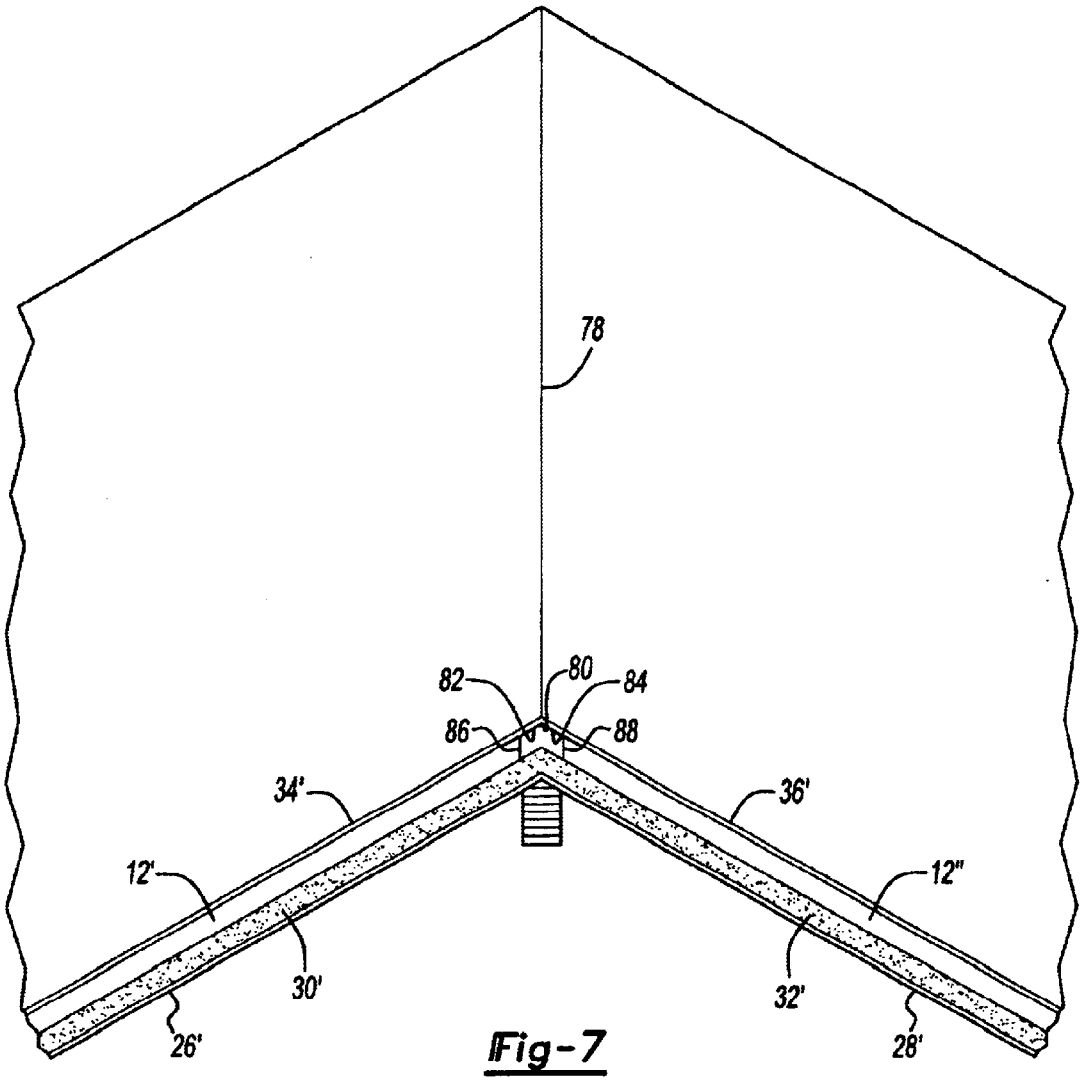
FIG. 7 is a side illustration of a pair panels interconnected by a hip cap.
Figure 8:
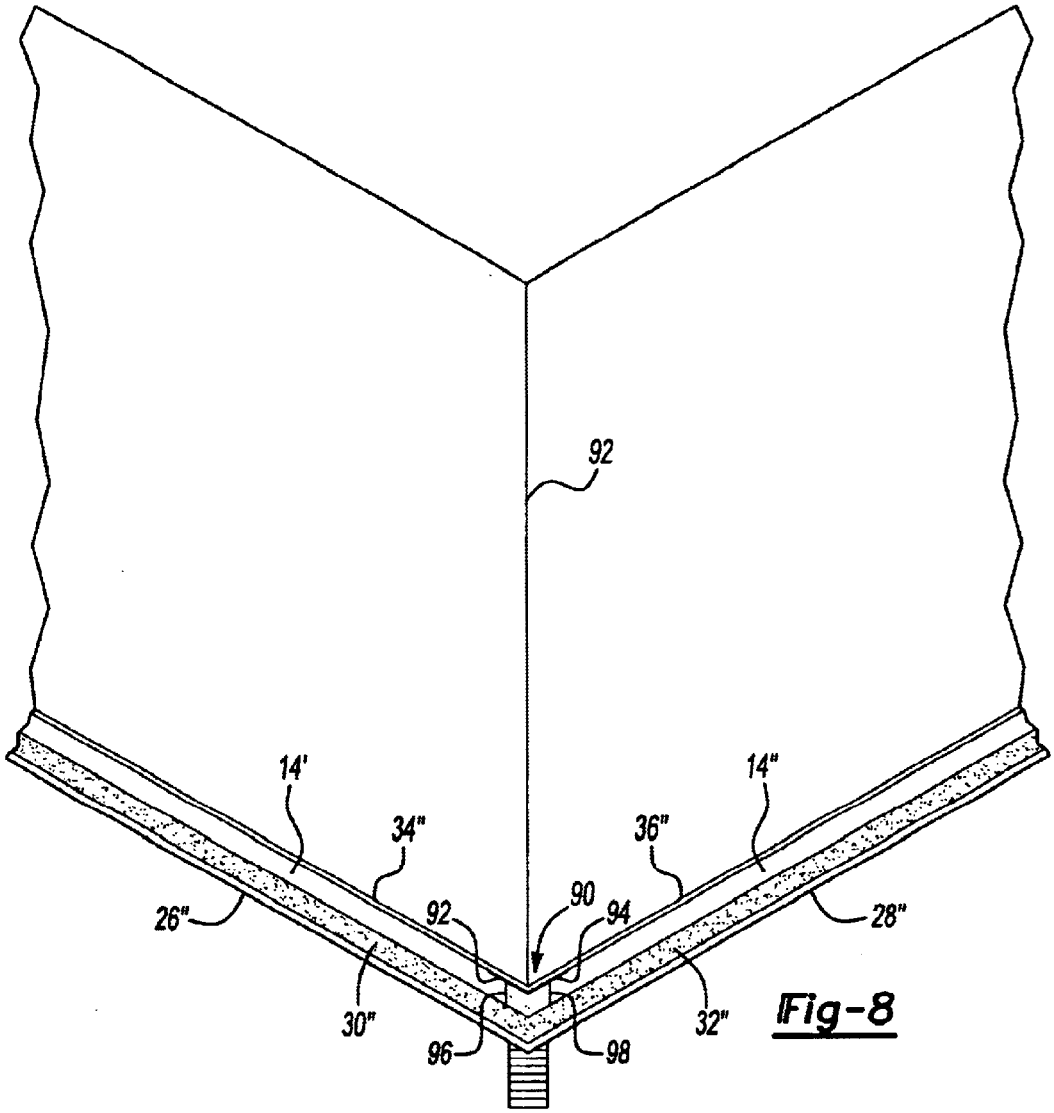
FIG. 8 is a side illustration of a further pair of panels interconnected by a valley cap.
Figure 9:
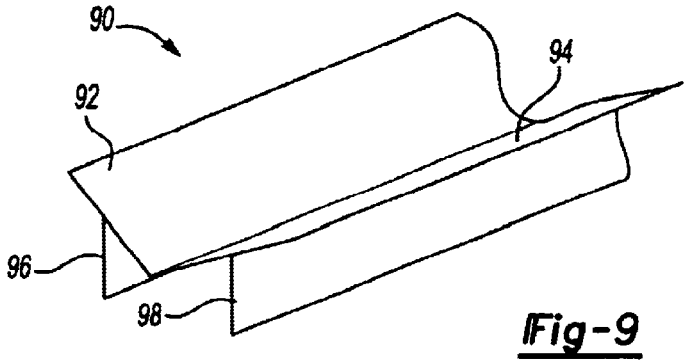
FIG. 9 is a perspective illustration of a valley cap component in use with the valley interconnection scheme of FIG. 8.

Referring finally to FIGS. 7–9, additional applications are disclosed relating to a cap construction for use in either of hip or valley edges associated with the roof construction. In particular, and referring first to FIG. 7, a hip connection is referenced by upwardly angled and peaking edges of planking sides 26' and 28', insulating layers 30' and 32' associated panel assemblies 12' and 12", and nailing layers 34' and 36'.

It is further desired to establish a closed connection at the hip edge, shown further at 78 in FIG. 7, and this is accomplished by a hip cap, illustrated generally at 80, and which extends fashion between side edges of selected and opposing panels (see again 12' and 12") extending in lengthwise fashion along in proximity to either of sides terminating in the hip edge 78 of the roof. The cap further includes, as is illustrated in cross section in FIG. 7, first 82 and second 84 angled and interconnected faces. A pair of legs 86 and 88 project from locations associated with the first 82 and second 84 faces and support the cap between the associated side extending edges of the panels 12' and 12", and in particular the associated and outermost airflow passages established by the panels.

As finally shown in FIG. 8, a valley connection is accomplished by a configuration of a hip cap, to a valley cap, illustrated generally at 90 (see also FIG. 9), and which extends between side edges of selected and opposing panels (see now at 14' and 14") extending in lengthwise fashion along in proximity to either of sides terminating in the valley edge 92 of the roof. Consistent with the general description of the hip cap 80 in FIG. 7, the valley cap 90 includes, as again illustrated in cross section in FIGS. 8 and 9, first 92 and second 94 angled and interconnected faces. A pair of legs. 96 and 98 project from locations associated with the first 92 and second 94 faces and support the cap between the associated side extending edges of the panels 14' and 14", and in particular the associated and outermost airflow passages established by the panels. The only meaningful difference between the hip cap 80 and valley cap 90 is in the inverting and angled arrangement between the angled and interconnecting faces and in order to conform to the desired hip or valley edge configuration along the roof.

Having described my invention, additional preferred embodiments will become apparent to those skilled in the art to which it pertains and without deviating from the scope of the appended claims:

I claim:

1. A ventilation system for use with a peaked roof, the roof extending between lower-most extending edges disposed proximate to fascia boards and an upper-most extending peak, said ventilation system comprising:

a plurality of interconnecting panels assembled upon at least first and second angled sides of the roof, each of said panels exhibiting a length, width and thickness and defining a plurality of internal and lengthwise extending airflow passages;

each of said panels exhibiting an overall rectangular shape and being constructed of a plasticized material, each of said panels further exhibiting a specified shape and size and further comprising a plurality of moisture reducing apertures formed between upper and lower facing surfaces, said apertures further being defined at spaced locations across at least one of first and second spaced apart and planar faces associated with each of said panels;

said panels being interconnected along at least one of opposing side and end extending edges and so that said airflow passages align between the lower-most extending edges of the roof and the upper-most extending edges, associated with the peak; and airflow currents being drawn through said aligned airflow passages of said interconnected panels, in an upwardly angled manner, and exhausted along the extending peak.

2. The ventilation system as described in claim 1, further comprising a vented ridge cap secured upon the peaked roof and in communication with said upper-most extending edges of said interconnected panels.

3. The ventilation system as described in claim 2, said vented ridge cap further comprising a substantially "V" shape in cross section and being spaced a predetermined distance above associated surface edges of said panels.

4. The ventilation system as described in claim 3, further comprising at least one layer of shingles secured atop first and second sides associated with said vented ridge cap.

5. The ventilation system as described in claim 1, said interconnecting panels exhibiting an overall specified shape and size, the roof further including a substrate planking layer, a succeeding insulation layer upon which is supported said panels, a roof nailing layer applied over said assembled panels, and pluralities of shingles secured upon the roof nailing layer.

6. The ventilation system as described in claim 1, each of said airflow passages further exhibiting a triangular shape in cross section.

7. The ventilation system as described in claim 1, further comprising a vented drip edge strip secured along at least one selected fascia board and in communicating fashion with the lower-most extending edges of said panels applied upon the roof.

8. The ventilation system as described in claim 7, said drip edge strip further comprising an angular configuration in cross section and including a plurality of apertures defined in a substantially horizontally extending surface of said strip and which communicate with said airflow passages associated with said interconnecting panels.

9. The ventilation system as described in claim 1, further comprising an elongated cap arranged in extending fashion between side extending edges of selected and opposing panels.

10. The ventilation system as described in claim 9, said cap further comprising, in cross section, first and second angled and interconnected faces, a pair of legs projecting from locations associated with said first and second faces and supporting said cap between said side extending edges of said panels.

11. The ventilation system as described in claim 10, said cap further comprising at least a hip cap or a valley cap for use with at least one of a hip or valley associated with the peaked roof.

12. The ventilation system as described in claim 1, further comprising a fan driven apparatus secured atop the peaked roof and in communication with said upper-most extending edges of said interconnected panels.

13. A ventilation system for use with a peaked roof, the roof extending between lower-most extending edges disposed proximate to fascia boards and an upper-most extending peak, said ventilation system comprising:

a plurality of interconnecting panels assembled upon at least first and second angled sides of the roof, each of said panels exhibiting a length, width and thickness and defining a plurality of internal and lengthwise extending airflow passages;

said panels being interconnected along at least one of opposing side and end extending edges and so that said airflow passages align between the lower-most extending edges of the roof and the upper-most extending edges, associated with the peak;

an elongated cap arranged in extending fashion between side extending edges of selected and opposing panels, said cap further comprising, in cross section, first and second angled and interconnecting faces, a pair of legs projecting from locations associated with said first and second faces and supporting said cap between said side extending edges of said panels, said cap further including at least one of a hip cap and a valley cap for use with at least one of a hip and valley associated with the peaked roof, each of said hip and valley caps further including elongate extending and interconnected planar faces and from which project a pair of parallel and likewise extending legs, said cap interconnecting first and second panels arranged in an angular orientation relative to the roof valley or peak; and airflow currents being drawn through said aligned airflow passages of said interconnected panels, in an upwardly angled manner, and exhausted along the extending peak in order to reduce thermal gain occurring from an exterior location of the roof in a first environmental condition and to reduce internal thermal loss from penetrating a covering material applied upon the roof in a second environmental condition.

* * * * *